United States Patent [19]

Bailey

[11] Patent Number: 4,915,431

[45] Date of Patent: Apr. 10, 1990

[54] ELECTROMAGNETIC LOCK HAVING A SELF-ADJUSTING SWITCH ASSEMBLY FOR DOOR-MOVEMENT ALERT

[75] Inventor: Kevin L. Bailey, Rolling Meadows, Ill.

[73] Assignee: Rixson-Firemark Inc., Franklin Park, Ill.

[21] Appl. No.: 315,617

[22] Filed: Feb. 27, 1989

[51] Int. Cl.[4] ..... E05C 17/56

[52] U.S. Cl. ..... 292/251.5; 292/DIG. 53; 292/DIG. 61

[58] Field of Search ..... 292/144, 201, 251.5, 292/341.16, DIG. 61, DIG. 53

[56] References Cited

U.S. PATENT DOCUMENTS

| | | | |
|---|---|---|---|
| 2,693,382 | 11/1954 | Teetor | 292/251.5 |
| 2,864,637 | 12/1958 | Teague et al. | 292/251.5 |
| 4,310,188 | 1/1982 | Aoki | 292/251.5 |
| 4,720,128 | 1/1988 | Logan, Jr. et al. | 292/251.5 |

*Primary Examiner*—Richard E. Moore

*Attorney, Agent, or Firm*—Augustus G. Douvas

[57] ABSTRACT

An electromagnetic lock including an armature and an electromagnet with the armature adapted for floating attachment to a door by a plunger-bolt assembly fixed to the door, and an electromagnet adapted for fixed attachment to a door frame. A door-movement alert switch structure comprising a pushbutton switch supported on the electromagnet, a plunger supported on the plunger-bolt assembly, and a spring force-biasing the plunger into mating contact with the switch when the door is electromagnetically locked to establish a first switch-actuation state. The force-biased spring maintains the switch in its first state while the armature is magnetically restrained. When the door is opened a door-movement distance slightly less than the armature float distance, the plunger is partially drawn into a plunger housing fixed on the plunger-bolt assembly. The switch responds by transferring to a second switch actuation state indicating an attempt to open the magnetically locked door.

13 Claims, 4 Drawing Sheets

ELECTROMAGNETIC LOCK HAVING A SELF-ADJUSTING SWITCH ASSEMBLY FOR DOOR-MOVEMENT ALERT

BACKGROUND OF THE INVENTION

This invention relates to electromagnetic locks, and in particular to a self-adjusting door-movement alert switch assembly which is operational while a door is magnetically locked.

Electromagnetic locks are commonplace in prior art security systems. These locks usually employ an electromagnet fixed to a door frame to attract and hold magnetically an armature plate fixed to a door hinged on the frame. Early electromagnetic lock designs permitted no movement of a door relative to its frame while the door was locked. An unauthorized attempt to open a door so locked went undetected until the lock was overpowered to break forcibly the armature plate away from the energized electromagnet. Detection after the lock was broken was unsatisfactory from a security aspect.

In most instances, however, a properly designed and installed electromagnetic lock could not be manually overpowered to open the lock. This was unacceptable in emergency situations, because it was imperative that immediate exit passage be possible through a door electromagnetically locked. This required opening the power circuitry to the electromagnet. However, the operating switch controlling power to the electromagnetic lock was visually located at a remote station manned by security personnel.

The foregoing operational deficiencies were overcome by altering electromagnetic lock designs so that the armature plate was no longer fixed to the door, but rather it was permitted to "float" movementwise a limited distance relative to the door. A door-movement alert switch was incorporated either on the door frame or on the electromagnet which responded to the limited movement of the door to complete electric circuitry which was capable of actuating an alarm, for example, at the remote security station. Security personnel could either take the necessary measures to thwart an unauthorized attempt to open the door, or alternatively power could be interrupted to the electromagnet to enable an immediate emergency exit.

The position and adjustment of the alert switch was fairly critical, because the switch had to effect contact transfer in response to a small movement of the locked door which was by necessity less than the limited movement of the door permitted by the floating armature plate. In many installations, the proper operational position of the alert switch could not be maintained due to settlement and warpage of either or both the door and the frame upon which it was hinged.

SUMMARY OF THE INVENTION

Accordingly, a principal object of this invention is to provide a door-movement alert switch assembly for an electromagnetic lock which is self-adjusting so as to compensate for the effects of door and frame warpage and building settlement.

Another object is to provide such a switch assembly which is secure from tampering which would defeat its door-movement alert function.

Another object is to improve security systems employing electromagnetic locks by providing a reliable and simple door-movement alert switch assembly.

A preferred embodiment of door-movement alert switch assembly of this invention comprises a pushbutton switch positioned within the central pole of the electromagnet core. A spring-biased plunger is supported on a bolt fixed to the door with the plunger being housed within a bore formed within the armature plate. The armature plate is also supported on the bolt and a housing for the plunger. The armature is permitted to float on this composite bolt-plunger housing subcombination by a set of bowed washers.

When the electromagnet is energized to lock a door to which the structure of this invention is applied, the plunger is biased into a mating relationship with the pushbutton switch during which the force exerted by the plunger maintains the switch in a first switching state. As the door is opened slightly, the plunger is retracted sufficiently by the bolt into the magnetically engaged armature, enabling the pushbutton switch to be spring-biased into a second switching state. This second switching state is attained before the door moves its maximum float distance. This transfer of switching states effects any desired security alert depending upon the specific circuitry connected to the pushbutton switch.

The door-movement alert switch assembly of this invention compensates for door and frame warpage because the spring-biased range of movement of the plunger maintains the necessary mating relationship with the pushbutton switch despite some relative movement between the door and frame caused by settling and warpage.

The switch assembly is also relatively secure from tampering because the pushbutton switch is preferably housed within the electromagnet core or housing, and the plunger and its housing are located within the armature.

DESCRIPTION OF THE DRAWINGS

In order that all of the structural features for attaining the objects of this invention may be readily understood, reference is made to the accompanying drawings wherein:

FIG. 2 is a view, principally in section, showing the position of the switch assembly in response to an energized electromagnet which locks the door;

FIG. 3 shows the extension of the plunger button of the switch assembly in response to a slight opening movement of the door;

FIG. 4 shows the further extension of the plunger button in response to an additional opening movement of the door adequate to cause transfer of the contacts of the plunger switch;

FIG. 5 shows the position of the switch assembly components in response to the release of the lock armature upon deenergization of the electromagnet;

DETAILED DESCRIPTION OF THE PREFERRED EMBODIMENT

Figure 1:
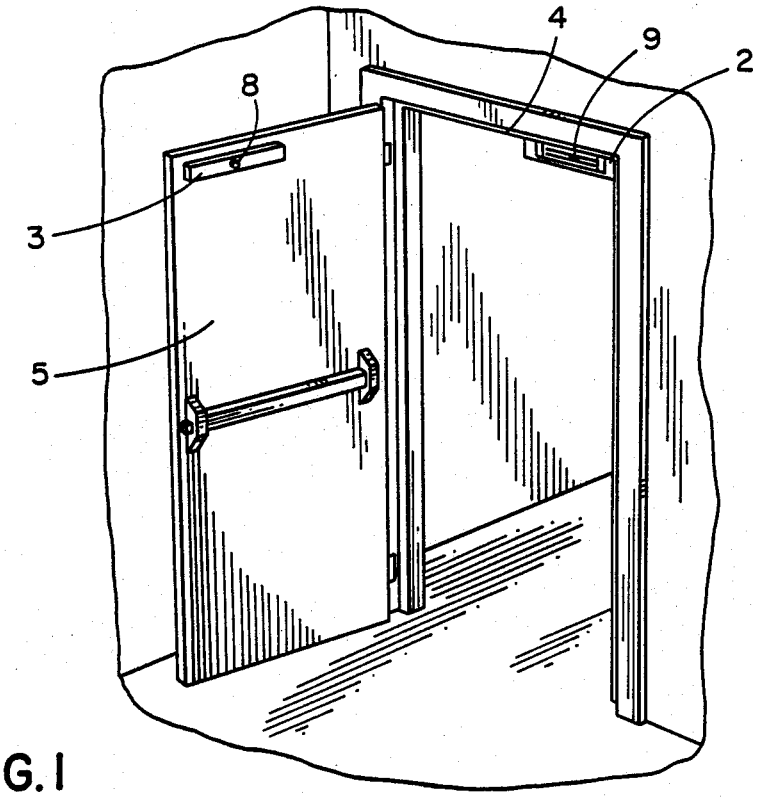
FIG. 1 is a perspective view of an open door and its door frame to which an electromagnetic lock has been applied.
Figure 2:
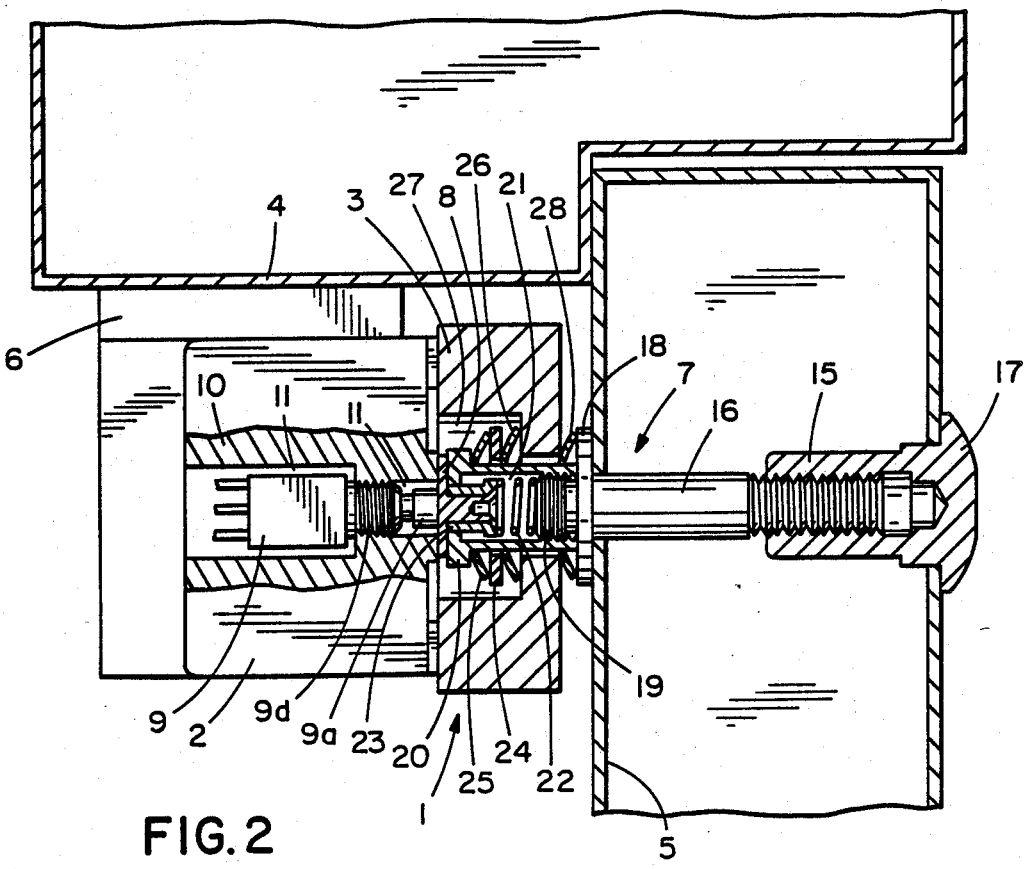
FIGS. 2 through 5 are an operational sequence of drawings showing the sequential positioning of the self-adjusting switch assembly of this invention used as an exit-alert sensor; and in particular.

Referring to the drawings, an electromagnetic lock 1 having as its principal components an electromagnet 2 and an armature plate 3 is shown applied to the underside of door header 4 and door 5 (FIG. 1). Electromagnet 2 typically may be embodied in an elongated housing which is fixedly secured to header 4 on the stop side of the door by mounting plate 6 (FIG. 2). Door 5 is locked by energizing electromagnet 2 to attract and hold armature plate 3 (FIG. 2).

Armature plate 3 is coupled to the face of door 5 by a plunger-bolt assembly 7 (FIG. 7) which permits the armature plate to "float" on and relative to assembly 7 when the door is electromagnetically locked.

As is well known in the prior art, (see U.S. Pat. No. 4,609,910) this floating action of the armature plate enables the door to open a limited distance, while electromagnetically locked, to activate door-alert circuitry. This circuitry is devised to render an alarm or other indication, that an attempt has been made to break the electromagnetic lock to open the door. The operation of the door-alert circuitry of the prior art is dependent upon a strictly-defined cooperative distance relationship between two elements, usually an armature plate and a pushbutton switch.

In many installations, this defined distance cannot be maintained because of door warpage or settling of the door frame. When any of these conditions occur, a false indication of the door status may follow defeating a proper door-alert function.

In the present invention, the otherwise defective operation of the circuitry caused by warpage and settling is compensated for by incorporating a unique spring-biased plunger 8 as part of assembly 7. Plunger 8 serves as an adjustable extension of assembly 7 and is capable of projecting beyond armature plate 3 to cooperate with a spring-biased pushbutton switch 9 as hereinafter set forth to compensate for warpage and settling.

Figure 4:
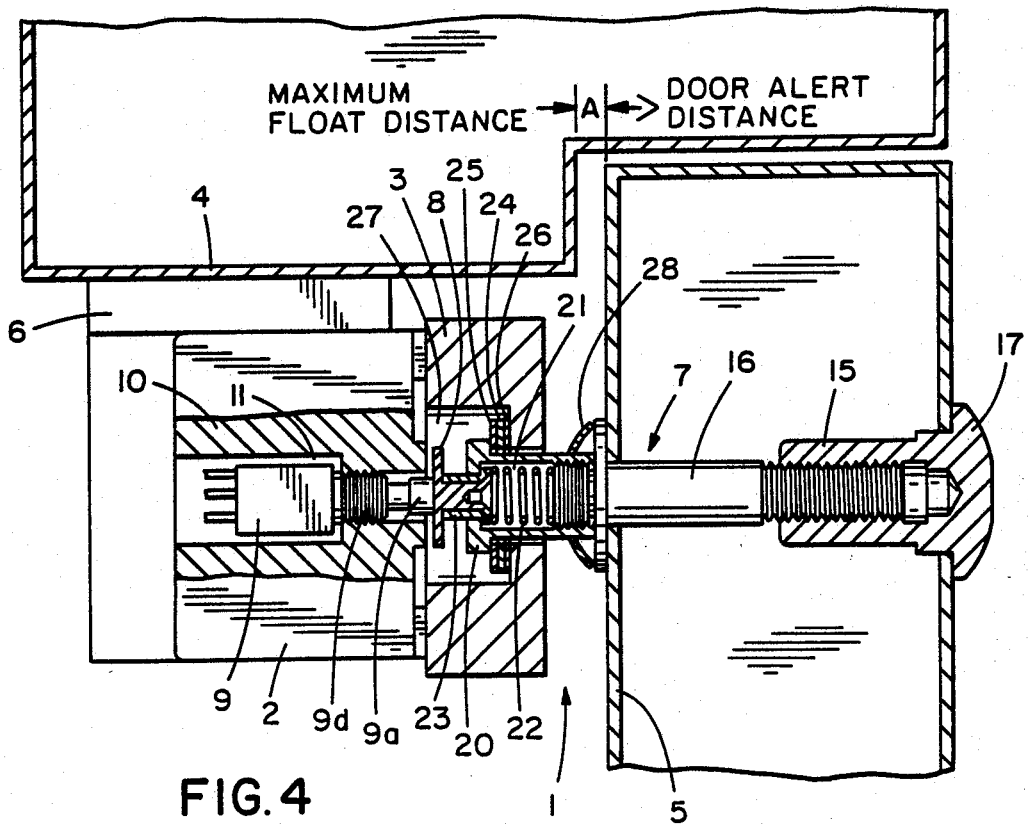

Pushbutton switch 9 is threaded into the central pole 10 of electromagnet 2 so that the switch-actuating pushbutton *9a* normally projects through and beyond the face of the electromagnet if not restrained by an opposing force applied by plunger 8. Switch 9 has a set of transfer contacts *9b*, *9c* (FIG. 6) which provide exit-alert sensing in response to a small amount of door-opening movement permitted by the floating action of armature plate 3 with door 5 nonetheless locked electromagnetically (FIG. 4).

Figure 5:
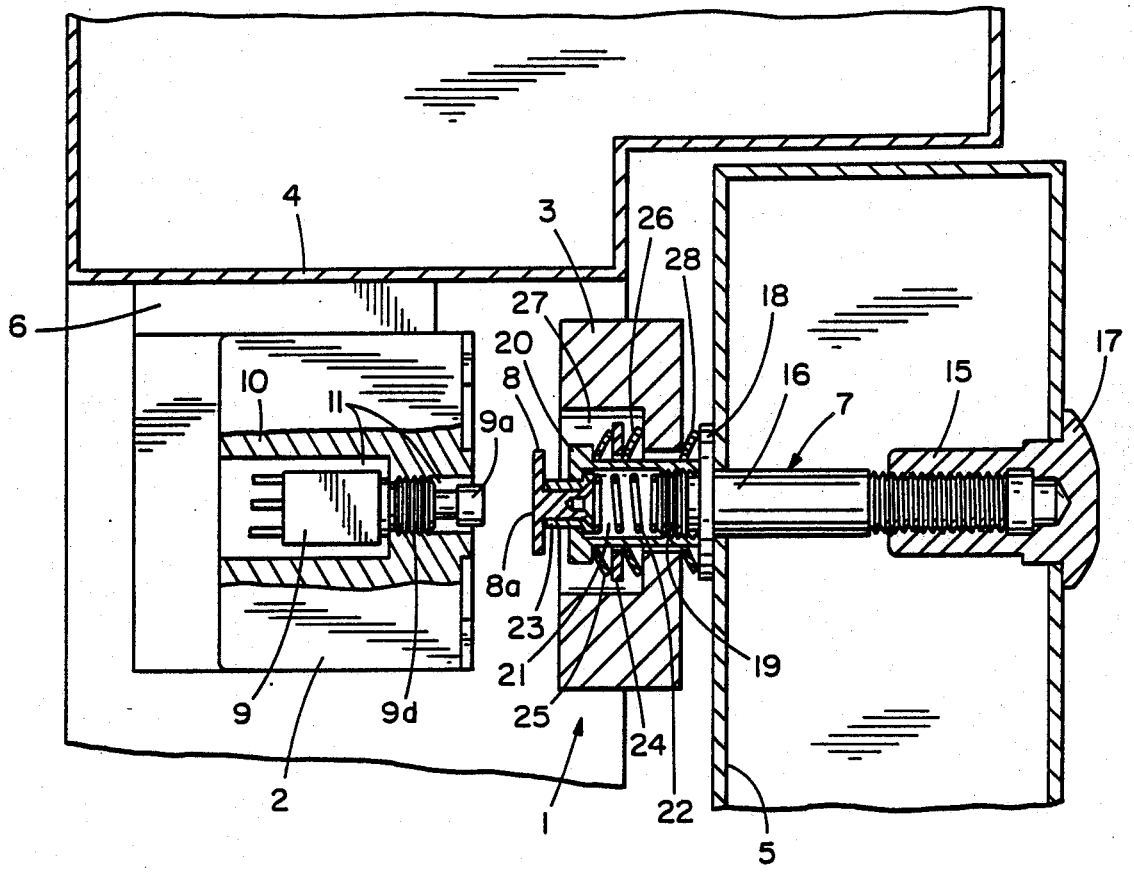
Figures 7, 8:
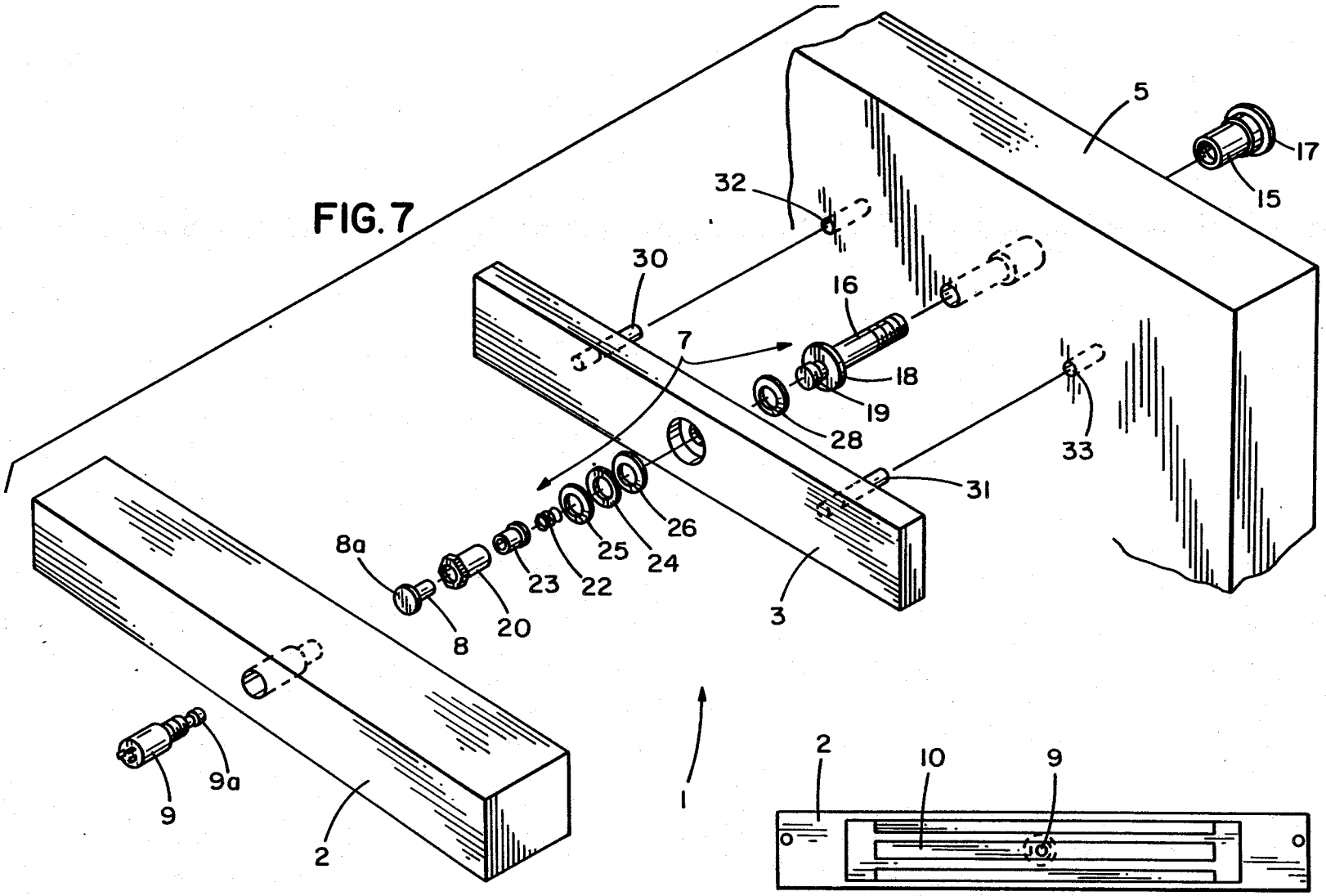
FIG. 7 is an exploded view of the principal components of the electromagnetic lock and its self-adjusting switch assembly.
FIG. 8 is an elevational view of the front face of the electromagnet which shows the central positioning of the door-status plunger switch.

As is shown in FIG. 8, pushbutton switch 9 is centrally located in central pole 10 of an E-shaped electromagnet core. Switch 9 is housed within a stopped bore 11 formed in central pole 10. Switch 9 has a threaded shank portion *9d* which engages mating internal threads formed into the wall of stepped bore 11. This threaded engagement enables the position of switch 9 to be adjusted relative central pole 10. The proper operational position for switch 9 is shown in FIG. 5. In particular, push-button *9a* must project beyond the adjacent pole face of central pole 10 when armature plate 3 is separated from electromagnet 2 (the door-open position).

Figure 6:
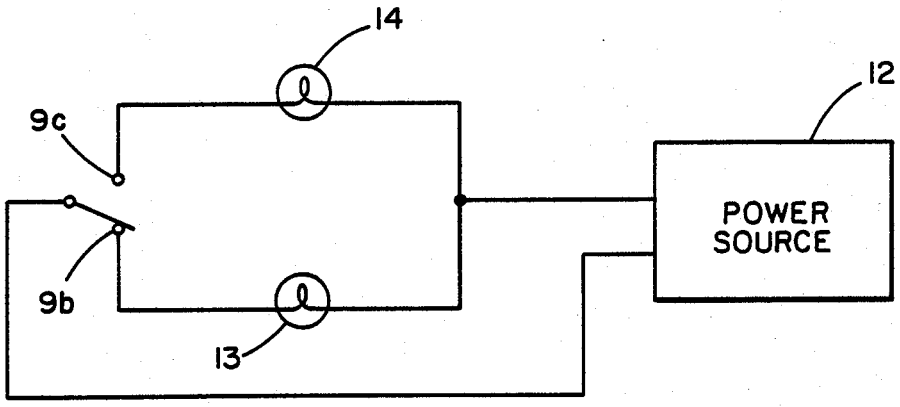
FIG. 6 is a simple electrical block diagram for operating the electromegnetic lock and also monitoring door status for exit-alert sensing.

As is later outlined in detail, the exposed face *8a* of plunger 8 mates with pushbutton *9a* when door 5 is electromagnetically locked (FIG. 2). The change in position of pushbutton *9a* from that of FIG. 2 to that of FIG. 5 causes a transfer of power from power source 12 through pushbutton contact *9b* to a circuit including pushbutton contact *9c* (FIG. 6). This transfer of power causes indicator light 13 (FIG. 6) to go out and indicator light 14 to go on. Indicator light 13 is illuminated to report an electromagnetically locked condition of door 5, and indicator light 14 is illuminated to announce that an attempt to open door 5 has been made.

Actual electromagnet release of door lock 1 is not necessary to cause transfer of power from contact *9b* to contact *9c*. Plunger-bolt assembly 7 permits door 5 to open and Maximum Float Distance "A", which is greater than the Door-Alert Distance (FIG. 4), thus causing switch 9 to transfer close-contact from *9b* to *9c*. The critical and required positioning adjustment of switch 9 on electromagnet 2 and relative to plunger 8 requires that switch 9 effect contact transfer somewhat before door 5 is opened the Maximum Float Distance "A" permissible before the electromagnetic lock is broken.

The detailed construction of plunger-bolt assembly 7 to enable armature 3 to float in excess of the Door-Alert Distance is as follows:

Hex nut 15 and shoulder screw 16, when joined, form a bolt which is fixed to door 5 by screwing the two parts together until head 17 of sex nut 15 and shoulder 18 of shoulder screw 16 are firmly secured to door 5 (FIGS. 2, 7). Threaded tip 19 of shoulder screw 16 projects beyond shoulder 18. Tip 19 is engaged by the internal threads of plunger housing 20. Plunger housing 20 has a generally cylindrical body which defines an internal cavity 21 which houses helical plunger-bias spring 22. Spring 22 is sandwiched between the flared end of plunger bushing 23 and the adjacent contacting face of threaded tip 19. Plunger bushing 23 is seated upon plunger 8, and the two parts reciprocate together relative plunger housing 20, with the limits of motion being defined by the enlarged circular head of plunger 8 and the flared end of plunger bushing 23. Plunger 8, plunger housing 20, plunger bushing 23 and spring 22 comprises a spring-biased assembly.

A flat washer 24, sandwiched between two bowed washers 25 and 26 are seated upon plunger housing 20. Washers 24, 25 and 26 are retained between a hex head of plunger housing 20 and the bottom of circular armature recess 27. Bowed washer 28 is also seated upon plunger housing 20. Washer 28 is sandwiched between shoulder 18 and the contacting face of armature plate 3. Bowed washers 25, 26 and 28 serve as compressible springs in the operation of plunger-bolt assembly 7. Bowed washers 25, 26 and 28 also serve to keep armature plate 3 from wobbling loosely relative assembly 7.

It is important to note that there are four compressible spring groups in the operation of the invention, namely 1. a spring (not shown) of part of switch 9
2. plunger-bias spring 22
3. bowed washer 28, and
4. bowed washers 25 and 26 which operate together, The force required to compress fully each of the four groups is different, and increases from group 1 to group 4. The operational reason for this increasing distribution of compression forces is best understood in conjunction with a step-by-step explanation of the relative movement of the principal components of the self-adjusting switch assembly of this invention from the door closed and locked position of FIG. 2 and progressing through the door partially open position of FIG. 3, the door more fully opened position (with transfer of pushbutton switch 9 contacts 9*b*, 9*c*) of FIG. 4, to the door fully opened position of FIG. 5.

In FIG. 2, door 5 is magnetically locked in response to the attraction of armature plate 3 by electromagnet 2. With the particular threaded adjustment of the parts represented, door 5 rests against the face of header 4. Washers 25, 26 and 28 remain in bowed condition, thereby holding door 5 firmly relative to electromagnetic lock 1. Plunger 8 is forced by plunger housing 20 against the face of central pole 10, thereby biasing switch pushbutton 9*a* into a retracted position. In this retracted position, contact 9*b* is closed (FIG. 6); and indicator light 13 is energized announcing that door 5 is magnetically locked.

Figure 3:
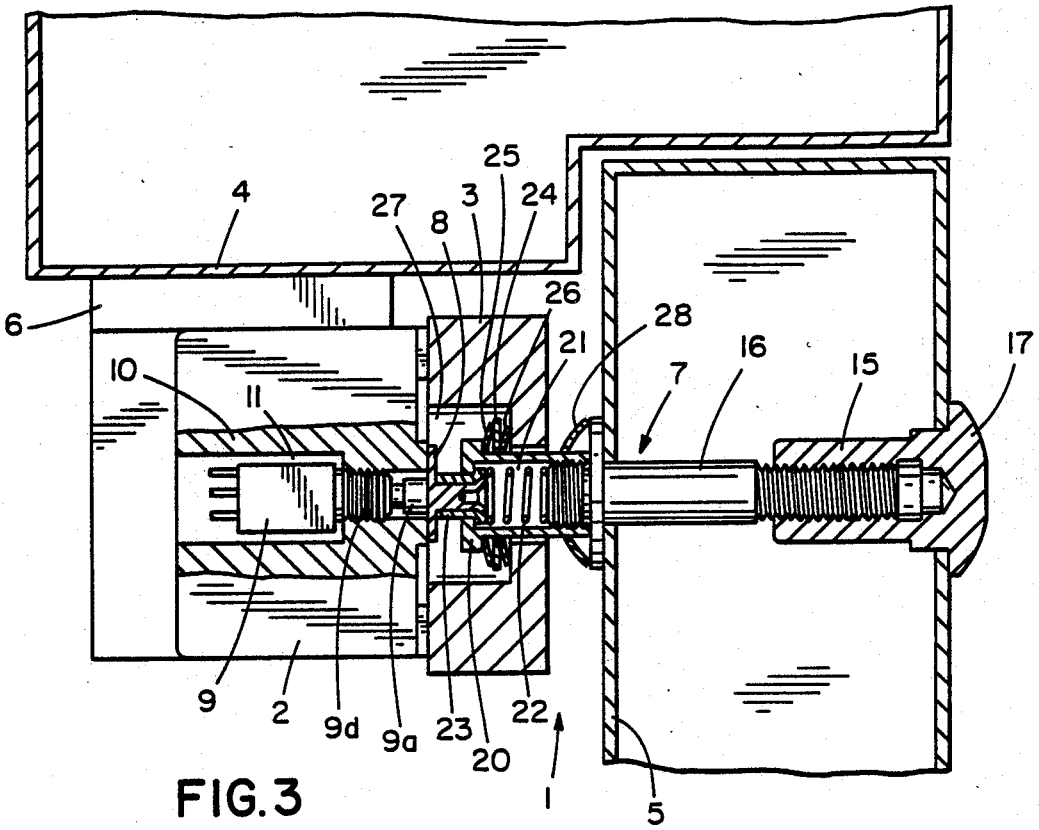

In FIG. 3, door 5 is partially opened, but the magnetic lock remains intact. Bowed washers 25 and 26 are partially compressed, and bowed washer 28 is separated from contact with armature plate 3. Pushbutton switch 9 does not change state, because plunger-bias spring 23 forces plunger 8 into a projecting position relative plunger housing 20 which maintains pushbutton 9*a* in the same position shown in FIG. 2. As a result, indicator light 13 continues to announce a magnetically locked door.

In FIG. 4, door 5 is further opened to the Maximum Float Distance "A", which is somewhat greater than the Door Alert Distance. Bowed washers are now fully compressed, and plunger-bolt assembly 7, draws plunger 8 away from central pole 10. As plunger 8 passes through the Door Alert Distance, pushbutton switch 9 changes sate, that is contact 9*b* is opened and contact 9*c* is closed. Contact 9*c* completes an energizing circuit for indicator light 14 thereby announcing an attempt to open door 5. Door 5 is nonetheless magnetically locked, because while armature plate 3 "floated" relative to plunger-bolt assembly 7, the plate remained fixed to electromagnet 2.

In FIG. 5, electromagnetic lock 1 is broken in response to deenergization of electromagnet 2, for example, by security personnel responding to a bona fide and authorized attempt to open door 5 in the FIG. 4 situation. Plunger 8 is fully projected by plunger-bias spring 22, and pushbutton 9*a* is also fully projected by the bias spring (not shown) of switch 9. Armature plate 9 is prevented from rattling on assembly 7 by the combined sandwiching forces exerted by bowed washers 25, 26 and 27. Spring pins 29 and 30 lodged in door spring-pin holes 31 and 32 and also similar holes (not shown) in armature plate 3 maintain the armature plate in its required horizontal position to properly face the poles of electromagnet 2.

It should be understood that the above described arrangements are merely illustrative of the principles of this invention. Modifications, such as changes in the indicator circuitry, can be made without departing from the scope of the invention.

What is claimed is:

1. In an electromagnetic lock including an armature an electromagnet with the armature adapted for floating attachment to a door by attachment means fixed to the door, and an electromagnet adapted for fixed mounting to an adjacent door element, the improved door-movement alert switch means comprising a switch supported relative the electromagnet, extensible means supported on the door attachment means, and means force-biasing the extensible means into mating contact with the switch when the door is electromagnetically locked to establish a first switch-actuation state, and the force-biased extensible means maintaining the switch in its first state while the armature is magnetically restrained in response to limited door movement.

2. The combination of claim 1 in which the switch is maintained in its first state when the limited door movement is less than the maximum distance the armature floats relative to any door to which it is attached.

3. The combination of claim 2 in which the switch is transferred to a second switch actuation state in response to an attempt to break a magnetic door locking condition in which the movement of the door is greater than the limited door movement but less than the maximum distance the armature floats relative to any door to which it is attached.

4. The combination of claim 3 in which the extensible means is a plunger, the force-biasing means in a spring, and the attachment means fixed to the door is a plunger-bolt assembly.

5. The combination of claim 4 in which the plunger-bolt assembly includes a plunger housing containing the spring and from which housing the plunger projects to establish a mating relationship with the switch when the door is magnetically locked.

6. The combination or claim 5 in which the switch is a pushbutton switch.

7. The combination of claim 6 in which the switch is partially housed within the electromagnet so that the switch pushbutton projects beyond the electromagnet.

8. The combination of claim 7 in which the electromagnet has a core within which the switch is partially housed.

9. The combination of claim 8 in which a set of bowed washers restrain the motion of the armature of the plunger-bolt assembly.

10. The combination of claim 9 in which the armature floats on the plunger housing and the bowed springs sandwich the armature.

11. In an electromagnetic lock including an armature and an electromagnet with the armature adapted for floating attachment to a door by attachment means fixed to the door, and the electromagnet adapted for fixed attachment to a door frame, improved door-movement alert switch means comprising a switch supported on the armature, and means force-biasing the attachment means into mating contact with the switch when the door is electromagnetically locked to establish a first switch actuation state, and the force-biased extensible means maintaining the switch in its first state while the armature is magnetically restrained to effect a lock.

12. An electromagnetic lock comprising an armature plate, an electromagnet adapted for fixed attachment to a door frame, a plunger-bolt assembly adapted for attachment to a door, a switch supported on the electromagnet, a plunger supported on the plunger-bolt assembly, and a spring force-biasing the plunger into mating contact with the switch when the door is electromagnetically locked to establish a first switch-actuation state, and the spring maintaining the switch in its first state while the armature is magnetically restrained.

13. The combination of claim 12 in which the switch is transferred to a second switch actuation state in response to a door-opening movement relative the door frame which movement causes the plunger to draw away from the electromagnet.

* * * * *